US008443569B2

(12) United States Patent
Sias

(10) Patent No.: US 8,443,569 B2
(45) Date of Patent: May 21, 2013

(54) FOUR-WAY RADIAL CONNECTOR

(75) Inventor: Stanley K. Sias, Hudson, WI (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 279 days.

(21) Appl. No.: 12/614,357

(22) Filed: Nov. 6, 2009

(65) Prior Publication Data

US 2011/0107710 A1 May 12, 2011

(51) Int. Cl.
*E04B 1/38* (2006.01)
*E04C 5/00* (2006.01)

(52) U.S. Cl.
USPC ..... 52/715; 52/712; 52/696; 52/702; 52/289; 52/92.1; 248/300

(58) Field of Classification Search ..... 52/712, 52/696, 643, 702, 714, 289, 715, 93.1, 92.1; 403/232.1, 243; 248/300
See application file for complete search history.

(56) References Cited

U.S. PATENT DOCUMENTS

| | | | |
|---|---|---|---|
| 414,169 | A | 10/1885 | Reuschel |
| 508,280 | A | 11/1893 | Cavallaro |
| 625,427 | A | 5/1899 | Stewart |
| 755,053 | A | 2/1904 | Eberhardt |
| 828,488 | A | 8/1906 | Lanz |
| 936,007 | A | 10/1909 | Mauborgne |
| 949,394 | A | 2/1910 | Daly, Daniel J. |
| 974,606 | A | 11/1910 | Schrader |
| 1,114,336 | A | 10/1914 | Blomqvist |
| 1,343,647 | A | 6/1920 | Smith |
| 1,568,072 | A | 1/1926 | Krueger |
| 1,719,440 | A | 7/1929 | Nathan |
| 1,785,791 | A | 12/1930 | Ropp |
| 1,787,167 | A | 12/1930 | Purdy |
| 1,925,804 | A | 9/1933 | Hiering |
| 1,945,925 | A | 2/1934 | Stiefel |
| 1,958,467 | A | 5/1934 | Buckle |
| 2,006,925 | A | 7/1935 | Klemp |
| 2,055,185 | A | 9/1936 | Templeton |
| 2,086,225 | A | 7/1937 | Hiering |
| 2,638,643 | A | 5/1953 | Olson |

(Continued)

FOREIGN PATENT DOCUMENTS

| | | |
|---|---|---|
| AU | 2008/233436 | 5/2010 |
| DE | 2744523 | 4/1978 |

(Continued)

OTHER PUBLICATIONS

RTA/RTB/RTF/RTT/RTU/FW2 Rigid Tie Connectors, Simpson Strong-Tie Connectors for Wood Construction Product & Instruction Manual Catalog, 1994, p. 67, C95H-1, Simpson Strong-Tie Company, Inc., Pleasanton, CA, USA.

(Continued)

*Primary Examiner* — William Gilbert
*Assistant Examiner* — Chi Q Nguyen
(74) *Attorney, Agent, or Firm* — James R. Cypher; Charles R. Cypher

(57) ABSTRACT

An improved connector and connection joining a plurality of supported structural members, preferably four roof trusses or rafters to a supporting structural member, preferably a header or girder truss. The connector is formed with a plurality of seat members, preferably four, that are joined to back member sections at angular junctures stiffened by shallow embossments. Variations can have three or five seat members.

30 Claims, 6 Drawing Sheets

U.S. PATENT DOCUMENTS

| | | | | |
|---|---|---|---|---|
| 2,711,917 | A | 6/1955 | Blu | |
| 2,889,179 | A | 6/1959 | Thompson | |
| 2,988,854 | A | 6/1961 | McKinley | |
| 2,990,590 | A | 7/1961 | Gravely | |
| 3,036,347 | A | 5/1962 | Findleton | |
| 3,041,033 | A | 6/1962 | Schwartz | |
| 3,055,103 | A | 9/1962 | Fernberg | |
| 3,271,861 | A | 9/1966 | Fusco | |
| 3,338,084 | A | 8/1967 | Stegman | |
| 3,338,875 | A | 8/1967 | Tracy | |
| 3,423,898 | A | 1/1969 | Tracey et al. | |
| 3,438,134 | A | 4/1969 | Schunk | |
| 3,457,647 | A | 7/1969 | Cohen | |
| 3,481,635 | A | 12/1969 | Tracy | |
| 3,596,941 | A | 8/1971 | Tracy | |
| 3,601,428 | A | 8/1971 | Gilb | |
| 3,627,075 | A | 12/1971 | Enders | |
| 3,633,950 | A | 1/1972 | Gilb | |
| 3,730,466 | A | 5/1973 | Swanquist | |
| 3,857,270 | A | 12/1974 | Iten | |
| 3,879,144 | A | 4/1975 | Eckerbrecht | |
| 3,972,169 | A | 8/1976 | Sheppard | |
| 4,092,809 | A | 6/1978 | Bella et al. | |
| 4,144,683 | A | 3/1979 | Dean | |
| 4,158,940 | A | 6/1979 | Lancelot | |
| 4,230,416 | A | 10/1980 | Gilb | |
| 4,261,155 | A | 4/1981 | Gilb | |
| 4,291,996 | A | 9/1981 | Gilb | |
| 4,353,664 | A | 10/1982 | Gilb | |
| 4,410,294 | A | 10/1983 | Gilb et al. | |
| 4,414,785 | A | 11/1983 | Howell | |
| 4,423,977 | A | 1/1984 | Gilb | |
| 4,426,814 | A | 1/1984 | Stuhmer | |
| 4,449,335 | A | 5/1984 | Fahey | |
| 4,480,941 | A | 11/1984 | Gilb | |
| 4,498,801 | A | 2/1985 | Gilb | |
| 4,523,412 | A | 6/1985 | Sielaff | |
| 4,525,972 | A | 7/1985 | Palacio et al. | |
| 4,551,957 | A | 11/1985 | Madray | |
| 4,560,301 | A | 12/1985 | Gilb | |
| 4,572,695 | A | 2/1986 | Gilb | |
| 4,598,521 | A | 7/1986 | Slapsys et al. | |
| 4,688,358 | A | 8/1987 | Madray | |
| 4,711,593 | A | 12/1987 | Wilhelmi | |
| 4,717,279 | A | 1/1988 | Commins | |
| 4,802,786 | A | 2/1989 | Yauger | |
| 4,817,359 | A * | 4/1989 | Colonias | 52/643 |
| 4,890,436 | A * | 1/1990 | Colonias | 52/643 |
| 4,893,961 | A | 1/1990 | O'Sullivan et al. | |
| 4,897,979 | A * | 2/1990 | Colonias | 52/643 |
| 4,920,725 | A * | 5/1990 | Gore | 52/702 |
| 4,932,173 | A | 6/1990 | Commins | |
| 4,964,253 | A | 10/1990 | Loeffler | |
| 5,004,369 | A | 4/1991 | Young | |
| 5,022,209 | A | 6/1991 | Kimura | |
| 5,042,217 | A | 8/1991 | Bugbee et al. | |
| 5,058,358 | A | 10/1991 | Stratton | |
| 5,104,252 | A | 4/1992 | Colonias et al. | |
| 5,197,241 | A | 3/1993 | Romeo et al. | |
| 5,203,069 | A | 4/1993 | Hennig | |
| 5,217,317 | A | 6/1993 | Young | |
| 5,220,766 | A | 6/1993 | Hills, Sr. | |
| 5,236,273 | A | 8/1993 | Gilb | |
| 5,253,465 | A * | 10/1993 | Gilb | 52/643 |
| 5,263,296 | A | 11/1993 | Spera | |
| 5,274,981 | A * | 1/1994 | Commins | 52/712 |
| 5,341,619 | A | 8/1994 | Dunagan et al. | |
| 5,364,312 | A | 11/1994 | Cunard et al. | |
| 5,367,853 | A | 11/1994 | Bryan | |
| 5,380,115 | A | 1/1995 | Colonias | |
| 5,380,116 | A * | 1/1995 | Colonias | 403/232.1 |
| D355,349 | S | 2/1995 | Taparauskas, Jr. | |
| 5,457,928 | A | 10/1995 | Sahnazarian | |
| D363,862 | S | 11/1995 | Lusignan | |
| D364,331 | S | 11/1995 | Leek | |
| 5,524,397 | A | 6/1996 | Byers et al. | |
| 5,598,680 | A | 2/1997 | Wilhelmi | |
| 5,603,580 | A | 2/1997 | Leek et al. | |
| 5,653,079 | A | 8/1997 | Loeffler et al. | |
| 5,666,774 | A | 9/1997 | Commins | |
| 5,678,379 | A | 10/1997 | Quattrociocchi | |
| D392,144 | S | 3/1998 | Vogler | |
| 5,727,831 | A | 3/1998 | Dritlein, Jr. | |
| 5,797,694 | A | 8/1998 | Breivik | |
| 5,806,265 | A | 9/1998 | Sluiter | |
| 5,951,078 | A | 9/1999 | Whitehead et al. | |
| 5,987,828 | A | 11/1999 | Hardy | |
| 6,230,466 | B1 | 5/2001 | Pryor | |
| 6,230,467 | B1 | 5/2001 | Leek | |
| 6,254,306 | B1 | 7/2001 | Williams | |
| 6,260,402 | B1 | 7/2001 | Leek | |
| 6,338,511 | B1 | 1/2002 | Douglas et al. | |
| 6,446,409 | B1 | 9/2002 | Emerson | |
| 6,513,298 | B2 | 2/2003 | Rassel | |
| 6,523,321 | B1 | 2/2003 | Leek et al. | |
| 6,560,943 | B1 | 5/2003 | Leek et al. | |
| 6,625,945 | B2 | 9/2003 | Commins | |
| 6,655,099 | B1 | 12/2003 | Trenoweth | |
| 6,662,517 | B1 | 12/2003 | Thompson | |
| 6,772,570 | B2 | 8/2004 | Horne | |
| 6,840,020 | B2 * | 1/2005 | Leek et al. | 52/712 |
| 6,983,548 | B1 | 1/2006 | Cook et al. | |
| 7,007,432 | B2 | 3/2006 | Commins | |
| 7,124,544 | B2 | 10/2006 | Brown et al. | |
| 7,334,372 | B2 | 2/2008 | Evans et al. | |
| 7,356,973 | B2 * | 4/2008 | Roesset et al. | 52/712 |
| 7,367,168 | B2 | 5/2008 | Lin | |
| 7,503,148 | B2 * | 3/2009 | Lin | 52/643 |
| 7,533,508 | B1 * | 5/2009 | diGirolamo et al. | 52/481.1 |
| 7,631,463 | B2 | 12/2009 | Greenlee et al. | |
| 7,913,472 | B2 * | 3/2011 | Troth et al. | 52/696 |
| 8,250,827 | B2 | 8/2012 | Lin et al. | |
| 2002/0002806 | A1 | 1/2002 | Commins et al. | |
| 2004/0079044 | A1 | 4/2004 | Troth et al. | |

FOREIGN PATENT DOCUMENTS

| | | | |
|---|---|---|---|
| EP | 0 357 273 | A1 | 3/1990 |
| EP | 1 413686 | A1 | 4/2004 |
| FR | 2740805 | | 5/1997 |
| GB | 185694 | | 9/1922 |
| GB | 422765 | | 1/1935 |
| GB | 1179267 | | 1/1970 |
| GB | 2 018 935 | | 10/1979 |
| GB | 2 070 184 | A | 9/1981 |
| GB | 2 228 955 | | 9/1990 |
| JP | 6-262267 | | 9/1994 |
| WO | WO 00/53352 | | 9/2000 |
| WO | WO 2007/000515 | | 1/2007 |
| WO | WO 2008/002814 | | 1/2008 |

OTHER PUBLICATIONS

Glulam Saddle Hanger, Strong-Tie Connectors Catalog, 1971, p. 13, 71H1, Simpson Strong-Tie Company, Inc., Pleasanton, CA, USA.

EPB44T Elevated Post Bases, Simpson Strong-Tie Connectors—Wood Constructions Connectors Catalog, 2000, p. 34, C02000, Simpson Strong-Tie Company, Inc., Pleasanton, CA, USA.

HJ Hip & Jack Truss Hanger, Product Data Sheet, 1986, Cleveland Steel Specialty Co., USA.

Structural Truss Connectors, Lumberlok: Structural Framing Connectors Catalog & Specifications, 1988, p. 37, Lumberlok, Hayward, CA, USA.

THJA26 Truss Hip and Jack Hanger, Product Data Sheet, 1991, Simpson Strong-Tie Company, Inc., San Leandro, CA, USA.

MTHM/MTHM-2 Multiple Truss Hangers, Simpson Strong-Tie Company Wood Construction Connectors Catalog, 1999, p. 92, C-2000, Simpson Strong-Tie Company, Inc., Pleasanton, CA, USA.

RTC Rigid Tie™ Connectors, Simpson Strong-Tie Company Wood Construction Connectors Catalog, 1999, p. 113, C-2000, Simpson Strong-Tie Company, Inc., Pleasanton, CA, USA.

SBV/CF Shelf Bracket—Concrete Form Angle, Simpson Strong-Tie Connectors for Wood Construction Product & Instruction Manual Catalog, 1994, p. 65, C95H-1, Simpson Strong-Tie Company, Inc., Pleasanton, CA, USA.

Panelized Construction, Handbook of Structural Designs & Load Values—Simpson Strong-Tie Timber Connectors Catalog, 1978, p. 16, 79H-1, Simpson Strong-Tie Co., Inc., USA.
Formed Seat Joist Hangers, Joist Hangers and Framing Connectors—Simpson Catalog, 1965, p. 3, 66H1, Simpson Strong-Tie Co., Inc., USA.
Konstruieren mit Sichtholz-Verbindern und der größten Auswahl einbaufertiger Serienteile, Bulldog-Simpson Bausysteme Für Holz catalog, 1999, p. 3, Bulldog-Simpson GMBH, Germany.
KANT-SAG, Cut & Bolt Kits from KANT-SAG, Catalog, USA.
Breakfast Nook Hangers—BN Series, USP Structural Connectors Catalog, 2007, p. 181, 2000-071, USP Structural Connectors, Burnsville, MN, USA.
Harrop, Helen, Examination Report Under Section 18(3) for Application No. GB1018829.0, Aug. 6 2012, Intellectual Property Office, UK.

* cited by examiner

FOUR-WAY RADIAL CONNECTOR

BACKGROUND OF THE INVENTION

This invention relates to a connector for joining structural members. In particular, the connector of the present invention has application as a sheet metal hanger for joining multiple truss and framing members.

In the particular application for joining structural members, the framing members may be either standard dimension lumber or wood trusses and truss girders. Specifically, the connection is most typically made at the juncture between (a) a supporting truss girder (or framing header) and multiple hip framing members (or wood trusses), (b) a framing header and multiple wood trusses, (c) a hip truss (or supporting wood framing member) and multiple jack trusses, (d) a supporting wood framing member and multiple supported wood framing members, (e) a jack framing member and multiple hip and jack trusses, or (f) a jack framing member and multiple wood framing members.

The connector, or hanger, of the present invention is designed to be installed on a nominal 2×4 bottom chord girder. The connector is a single-piece, non-welded design that does not need carried truss side-plates, so it is not limited by the installer's ability to place nails into the side faces of the supported, or carried, structural members. The connector 6 of the present invention is cheaper to manufacture than competing products and uses fewer fasteners to install.

The connector of the present invention is ideally suited for any small roof niche framing. Modern architectural plans often include small sunrooms, libraries or sitting rooms where the width of the framing is 20 feet or less and the roof is framed as a radial or angular turret-type structure. The connector of the present invention is particularly designed for these low-to-medium load applications.

The connector of the present invention can be made from sheet metal using a substantially rectangular blank that minimizes waste.

Prior art U.S. Pat. No. 7,503,148, granted to Jin-Jie Lin teaches a sheet metal connector for holding up to four trusses or framing members and is herein incorporated by reference and made part of this application. U.S. Pat. No. 5,253,465, granted to Tyrell T. Gilb also teaches a sheet metal connector for connecting multiple truss connections and is herein incorporated by reference and made part of this application. U.S. Pat. No. 4,817,359 teaches a similar connection with a sheet metal hanger and is herein incorporated by reference and made part of this application. None of these patents, however, teach the improved connector or connection of the present invention for holding up to four trusses or framing members.

SUMMARY OF THE INVENTION

An object of the present invention is to provide an improved connection in which a plurality of supported structural members are hung from a single supporting structural member, and this is achieved more cheaply and easily by using a single connector having multiple supporting structural member-carrying seats that join to corresponding support sections, the joint being stiffened by an embossment that extends from the seat into the corresponding support section.

A further object of the invention is to support structural members with substantially vertical attachment faces, where the structural members are preferably roof trusses or rafters.

A further object of the invention is to provide a connector with a back member having a series of at least two angularly joined support sections, one first and one last, and a pair of attachment sections that join the first and last support sections, for attachment to the supporting structural member.

A further object of the invention is to provide a connector with substantially rectangular, planar support sections, attachment sections and seat members, all readily, and cheaply formed from sheet metal on automated machinery.

A further object of the invention is to provide attachment sections with fastener opening to facilitate fastening to the supported structural member with separate pin-type fasteners, such as nails or screws.

A further object of the invention is to provide a connector with support sections that have their joints reinforced with embossments, preferably in the form of gussets, and to also provide the joints between the attachments sections and the first and last support sections with reinforcing embossments, also preferably in the form of gussets.

A further object of the invention is to provide a connector that evenly and correctly angles and spaces the supported structural members.

A further object of the invention is to provide shallow, elongate embossments that traverse the joint between the support sections and the seat members, reinforcing and stiffening that joint and stiffening both of the joined parts, without interfering with the interface with the supported structural members.

A further object of the invention is to provide a connector that carries the supported structural members without fastening to the sides of the supported structural member. This is achieved by providing substantially flat seat members that preferably have only small retention tabs that interface with the sides of the supported structural members.

A further object of the invention is to provide a connector that carries the supported structural members with minimal fastening. This is achieved by using a single screw that passes through the seat member into the bottom of the supported structural member.

A further object of the invention is to provide a connector that allows all of the supported structural members to closely align with the back of the connector and to abut the back of the connector. This is achieved by arcing the back of the connector away from the supporting structural member.

A further object of the invention is to provide a connector blank that minimizes waste. This is achieved by cutting a blank that has no internal gaps and is substantially rectangular, with rectangular sub-parts.

DETAILED DESCRIPTION OF THE PREFERRED EMBODIMENTS OF THE INVENTION

Figure 5:
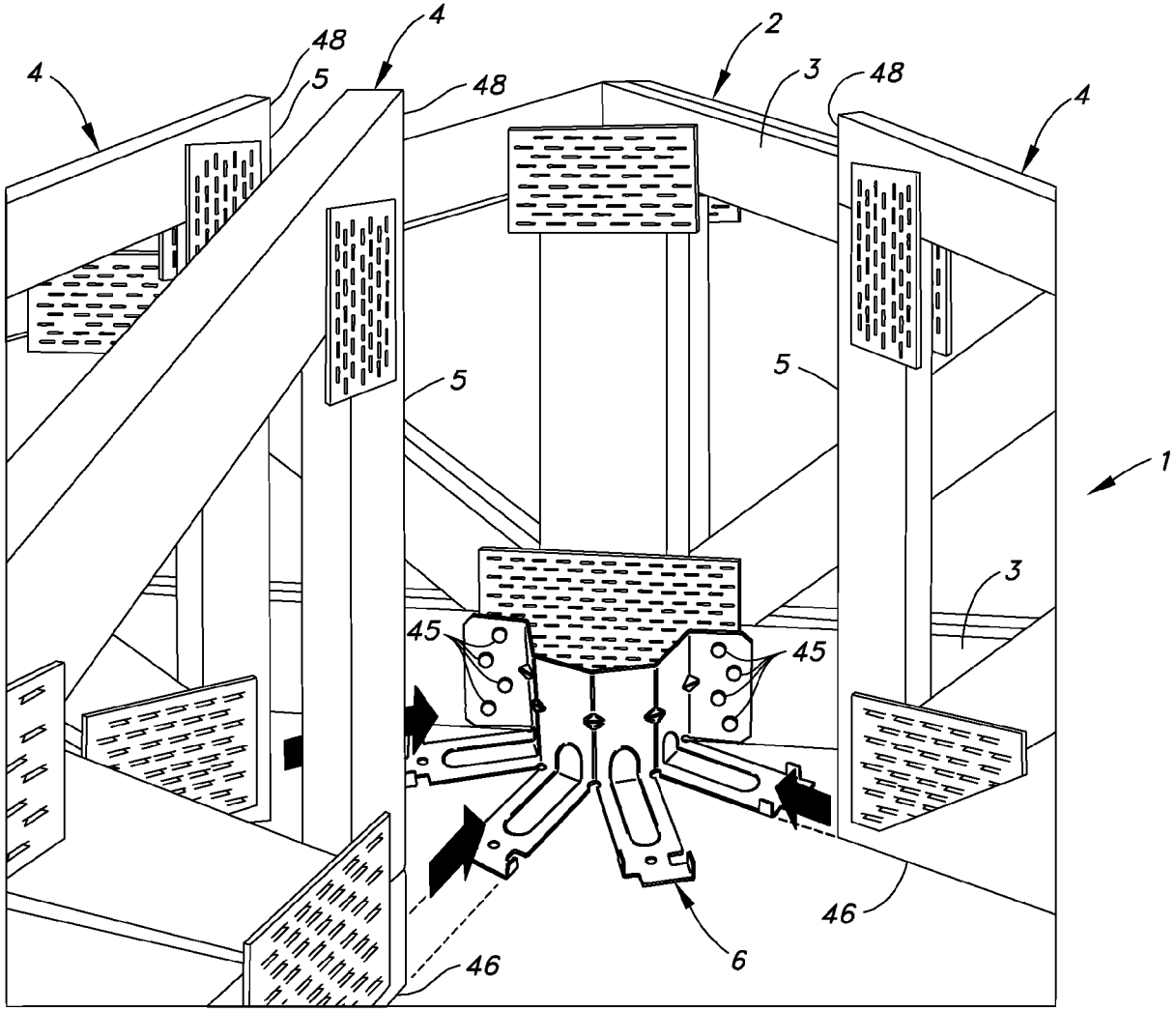
FIG. 5 is a perspective view of the connection of the present invention.

As shown in FIG. 5, the present invention is a structural building connection 1 having a supporting structural member 2, a plurality of supported structural members 4, and a connector 6.

As shown in FIG. 5, the supporting structural member 2 has an attachment face 3. Each of the plurality of supported structural members 4 has an attachment end 5.

Figure 1:
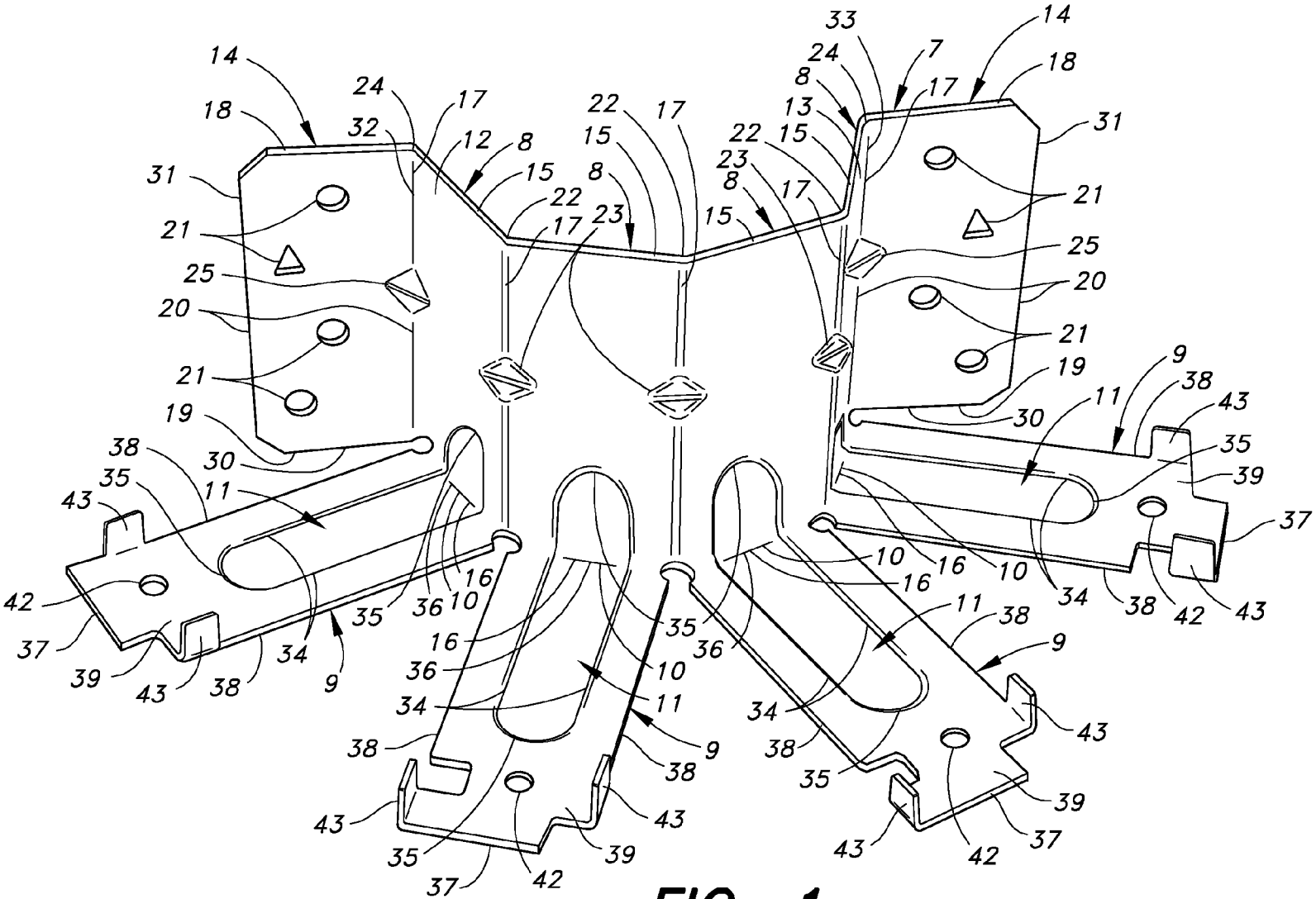
FIG. 1 is a perspective view of the connector of the present invention.

As shown in FIG. 1, the connector 6 preferably has a back member 7, a plurality of seat members 9, and preferably has a plurality of seat support embossments 11.

As shown in FIG. 1, the back member 7 is divided into a plurality of support sections 8. Each of the seat members 9 is attached to at least one support section 8 at an angular juncture 10. In the preferred embodiments, the angular juncture 10 is less than 180 degrees where the connector 6 faces away from the supporting structural member 2 and toward the supported structural members 4. Most preferably, this angular juncture 10 is right-angled, as when the supported structural members 4 are trusses 4. The angular juncture 10 can be obtuse, as when the supported structural member 4 are rafters 4. Each of the support embossments 11 passes through at least one of the angular junctures 10 from a support section 8 to a seat member 9, reinforcing the angular juncture 10 between the support section 8 and the seat member 9. Each of the support embossments 11 extends away from an angular juncture 10 into a support section 8 and into an adjoining seat member 9.

Preferably, a plurality of supported structural members 4 is attached to a plurality of the seat members 9 adjacent the attachment ends 5 of the supported structural members 4. Each supported structural member 4 has an end face 48 that is closely adjacent, and parallel to, one of the support sections 8 of the back member 7 of the connector 6.

Each supported structural member 4 preferably has an end face 48, and each end face 48 of each supported structural member 4 abuts one of the support sections 8 of the back member 7 of the connector 6.

Preferably, each of the support sections 8 has an outer face 26 and an inner face 27, the outer face 26 facing out and away from the supporting structural member 2, and the inner face 27 facing in and toward the supporting structural member 2. The inner faces 27 of the support sections 8 do not interface with the supporting structural member 2.

As shown in FIG. 5, the back member 7 of the connector 6 is fastened to the attachment face 3 of the supporting structural member 2. Preferably, the back members is fastened with a plurality of separate fasteners 45.

Figure 3:
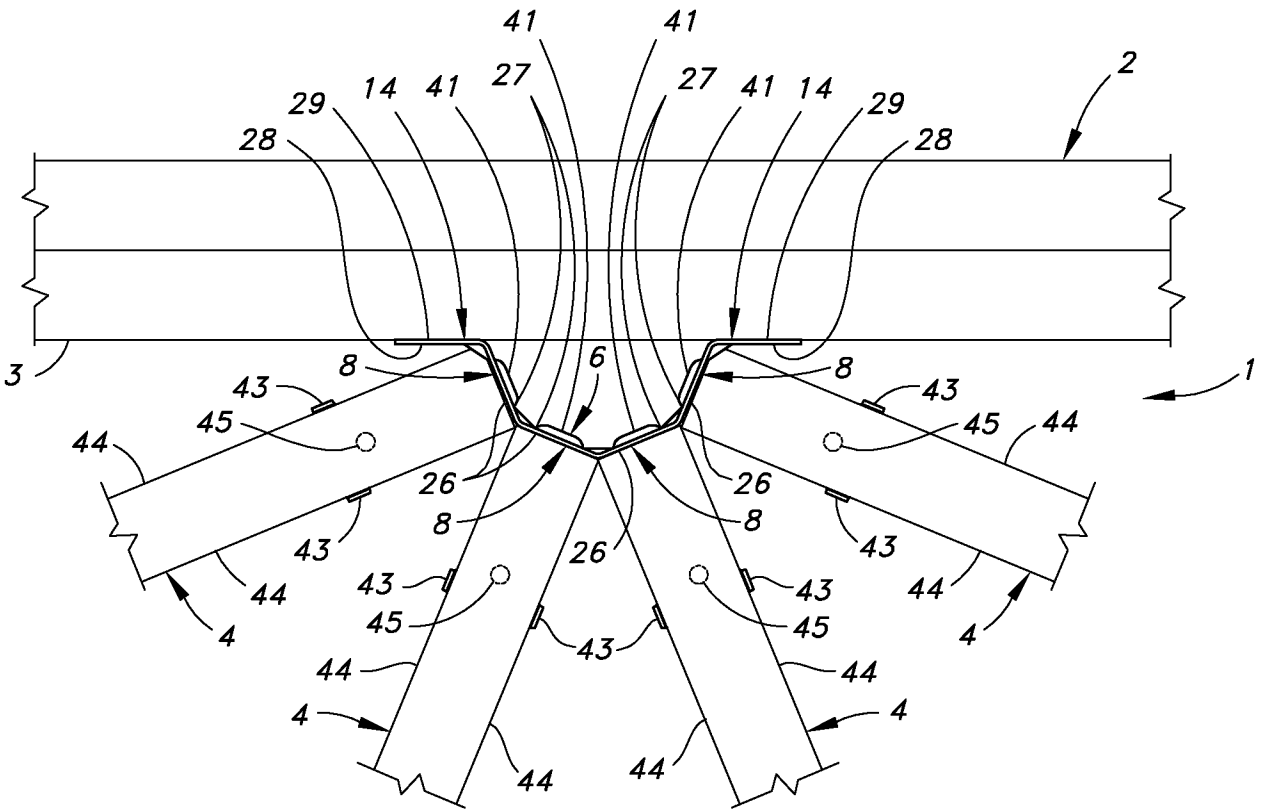
FIG. 3 is a top plan view of the connection of the present invention.

As shown in FIG. 3, at least one supported structural member 4 is attached to at least one of the seat members 9 adjacent the attachment end 5 of the supported structural member.

Preferably, as shown in FIG. 5, the attachment face 3 of the supporting structural member 2 is substantially vertical. In one embodiment, the supported structural members 4 preferably are rafters 4.

Preferably, as shown in FIG. 1, each of the each of the support sections 8 of the back member 7 is angularly joined to another of the support sections 8. The support sections 8 are joined in series from a first support section 12 to a last support section 13.

The back member 7 preferably has a first attachment section 14 and a second attachment section 14. The first attachment section 14 is angularly joined to the first support section 12. The second attachment section 14 is angularly joined to the last support section 13. The first attachment section 14 is fastened to the attachment face 3 of the supporting structural member 2. The second attachment section 14 is fastened to the attachment face 3 of the supporting structural member 2.

Preferably, each of the support sections 8 has an upper edge 15, a lower edge 16, a first side edge 17 and a second side edge 17.

In the preferred embodiment, each of the support sections 8 preferably is generally rectangular. At least a portion of the upper edge 15 is straight and parallel to a straight portion of the lower edge 16. At least a portion of the first side edge 17 is straight and parallel to a straight portion of the second side edge 17.

Preferably, as shown in FIG. 1, each of the attachment sections 14 has an upper edge 18, a lower edge 19, a first side edge 20 and a second side edge 20.

Each of the attachment sections 14 preferably is generally rectangular. The lower edge 19 includes a straight portion 30. The second side edge 20 includes a straight portion 31. At least a portion of the upper edge 18 is straight and parallel to a straight portion of the lower edge 19. At least a portion of the first side edge 20 is straight and parallel to a straight portion of the second side edge 20.

Preferably, each of the attachment sections 14 has a plurality of fastener openings 21.

The support sections 8 preferably meet each other at an angular juncture 22 that is reinforced by a substantially rigid embossment 23.

Preferably, as shown in FIG. 1, the first attachment section 14 and the first support section 8 meet at an angular juncture 24 that is reinforced by a substantially rigid embossment 25. The second attachment section 14 and the last support section 8 meet at an angular juncture 24 that is reinforced by a substantially rigid embossment 25.

The substantially rigid embossments 25 preferably are gussets 25.

Preferably, there are four support sections 8. Each of the support sections 8 has an outer face 26 and an inner face 27, the outer face 26 facing out and away from the supporting structural member 2, and the inner face 27 facing in and toward the supporting structural member 2. The support sections 8 meet each other at an angular juncture 22 that defines an angle of 135 degrees between the corresponding inner faces 27 of the support sections 8.

In the preferred embodiment with four attachment sections 14, each of the first and second attachment sections 14 preferably has an outer face 28 and an inner face 29, the outer face 28 facing out and away from the supporting structural member 2, and the inner face 29 facing in and toward the supporting structural member 2. The first support section 12 and the first attachment section 14 meet at an angular juncture 24 or 32 that defines an angle of 112.5 degrees between the corresponding outer faces 26 and 28 of the first support section 12 and the first attachment section 14. The last support section 13 and the second attachment section 14 meet at an angular juncture 24 or 33 that defines an angle of 112.5 degrees between the corresponding outer faces 26 and 28 of the last support section 13 and the second attachment section 14.

Preferably, as shown in FIG. 1, the seat support embossments 11 are obround, each having a pair of substantially parallel sides 34 and a pair of rounded ends 35 that connect each pair of substantially parallel sides 34.

Each of the seat members 9 preferably has an upper edge 36, a lower edge 37, a first side edge 38 and a second side edge 38.

Preferably, each of the seat members 9 is generally rectangular.

Figure 6:
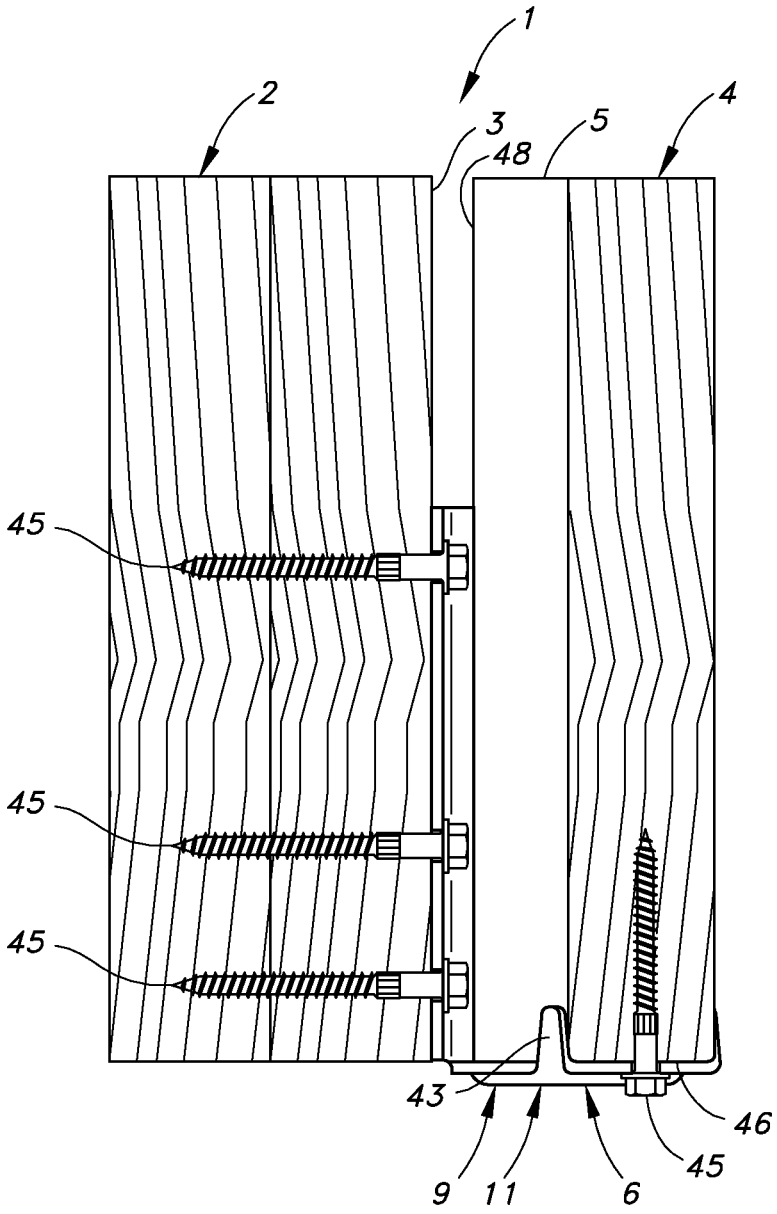
FIG. 6 is a side elevation view of the connection of the present invention.

As shown in FIG. 6, each of the seat members 9 preferably has an upper face 39 and an lower face 40, the upper face 39 facing toward one of the supported structural members 4, and the lower face 40 facing away from one of the supported structural members 4.

Figure 4:
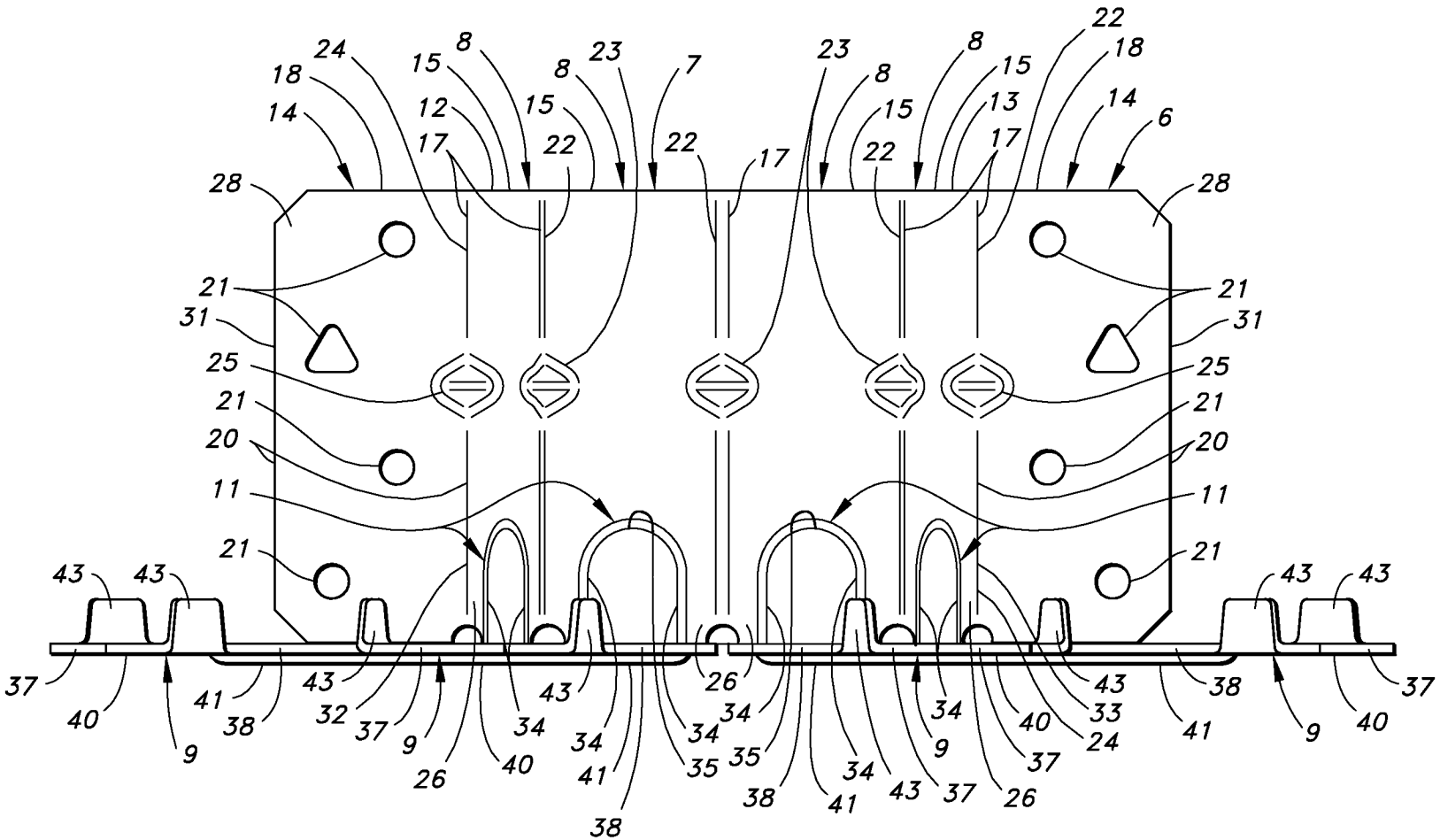
FIG. 4 is a front elevation view of the connector of the present invention.

Preferably, each of the support sections 8 has an outer face 26 and an inner face 27, the outer face facing 2628 out and away from the supporting structural member 2, and the inner face 27 facing in and toward the supporting structural member 2. Each of the seat support embossments 11 is embossed into the upper face 39 of one of the seat members 9 and the outer face 26 of one of the support sections 8, indenting the upper face 39 and the outer face 8, and creating an depressed portion 41 in the inner face 27 of the support section 8 and in the lower face 40 of the seat member 9, as shown in FIG. 4.

Each of the seat support embossments 11 preferably is embossed to a depth of less than 0.25 inches.

Preferably, each of the seat support embossments 11 is embossed to a depth of 0.125 inches.

Each of the seat members 9 preferably has at least one fastener opening 42.

Preferably, as shown in FIG. 1, at least one of the fastener openings 42 in each of the seat members 9 is not within the seat support embossment 11 in the seat member.

Each of the support sections 8 preferably has an upper edge 15. One of the rounded ends 35 of each of the seat support embossments 11 faces the upper edge 15 of one of the support sections 8. Each of the seat members 9 has a lower edge 37. One of the rounded ends 35 of each of the support embossments 11 faces the lower edge 37 of one of the seat members 9. The rounded ends 35 bow outward so that the rounded ends 35 are concave within the embossments 11 and convex outside the embossments 11. The convexities face the upper edges 15 of the support sections 8 and the lower edges 37 of the seat members 9.

Preferably, each of the seat members 9 has first and second side edges 38. Each of the support embossments 11 is centered between the first and second side edges 38 of one of the seat members 9, and the sides 34 of the support embossment 11 are parallel to the first and second side edges 38 of the seat member 9.

As shown in FIG. 1, the first side edge 38 of each seat member 9 preferably has a retention tab 43 adjacent the lower edge 37 of the seat member 9. The second side edge 38 of each seat member 9 has a retention tab 43 adjacent the lower edge 37 of the seat member 9.

Preferably, the supported structural members 4 each have first and second sides 44. The retention tabs 43 are bent up 90 degrees from each seat member 9 to match the first and second sides 44 of the supported structural members 4.

Each of the seat members 9 preferably has an upper face 39 and an lower face 40, the upper face 39 facing toward one of the supported structural members 4, and the lower face 40 facing away from one of the supported structural members 4. Each of the support sections 8 has an outer face 26 and an inner face 27, the outer face 26 facing out and away from the supporting structural member 2, and the inner face 27 facing in and toward the supporting structural member 2.

Preferably, each angular juncture 10 between a support section 8 and a seat member 9 defines an angle of 90 degrees between the outer face 26 of that support section 8 and the upper face 39 of that seat member 9.

Each of the seat members 9 preferably is attached only to one of the plurality of support sections 8.

Preferably, as shown in FIG. 6, each of the seat members 9 has an upper face 39 and an lower face 40, the upper face 39 facing toward one of the supported structural members 4, and the lower face 40 facing away from one of the supported structural members 4. Each supported structural member 4 is supported only by the upper face 39 of one of said seat members 9.

The supporting structural member 2 preferably is a girder truss 2. The supported structural members 4 are trusses 4.

Preferably, the supporting structural member 2 is a wood girder truss 2. The supported structural members 4 are wood trusses 4.

As shown in FIG. 6, each of the supported structural members 4 preferably has a bottom face 46. At least one separate fastener 45 passes through each of the seat members 9 of the connector 6 into the bottom face 46 of one of the supported structural members 4.

Preferably, a single separate fastener 45 passes through each of the seat members 9 into the bottom face 46 of one of the supported structural members 4.

At least one separate fastener 45 preferably passes through each of the attachment sections 14 of the connector 6 into the attachment face 3 of the supporting structural member 2.

Preferably, three separate fasteners 45 pass through each of the attachment sections 14 of the connector 6 into the attachment face 3 of the supporting structural member 2.

The fasteners 45 preferably are screws.

Figure 2:
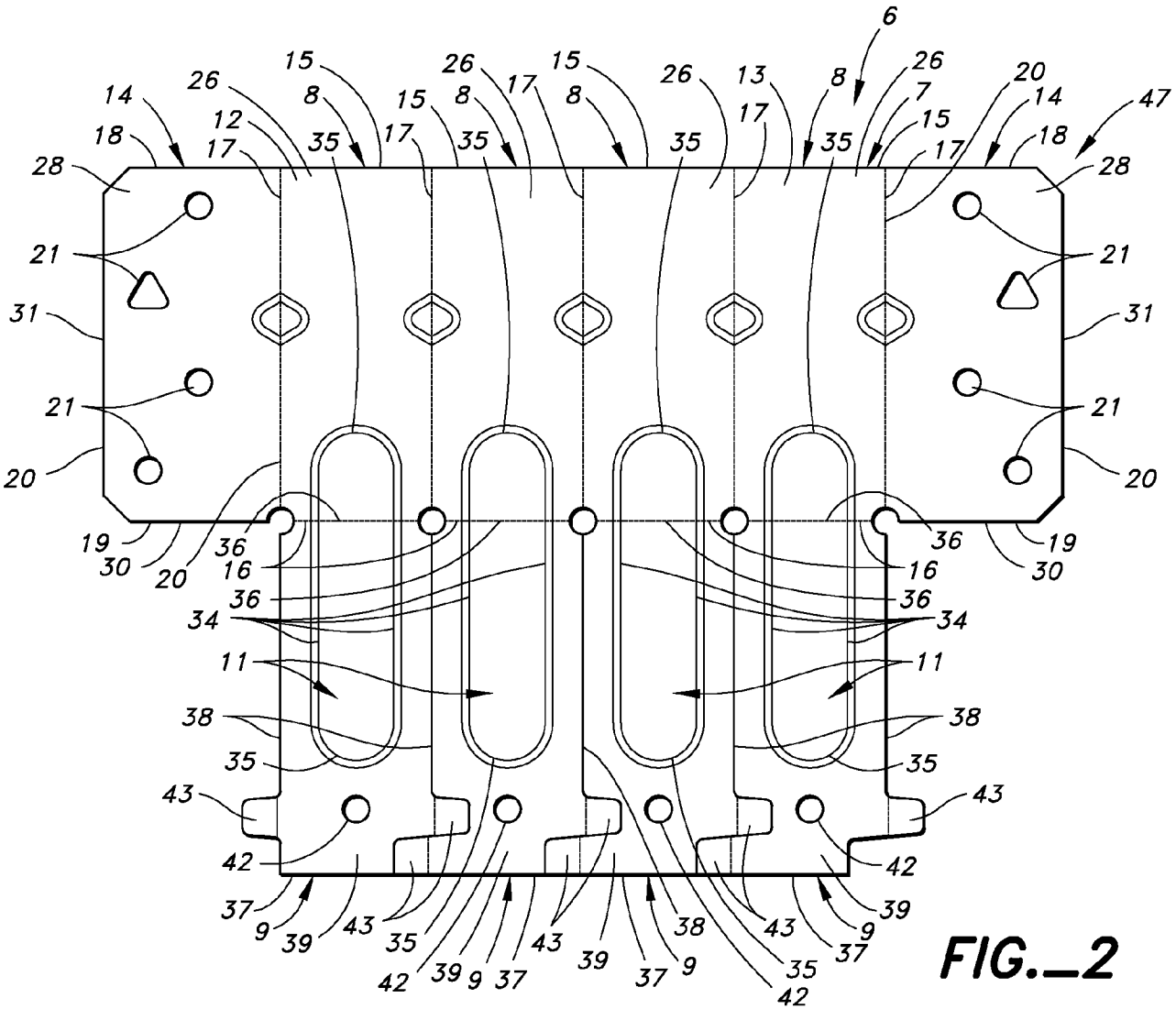
FIG. 2 is a top plan view of the sheet metal black of the connector of the present invention.

The present invention includes a method of forming a structural building connector 6. The method preferably comprises cutting a generally rectangular blank 47 from sheet metal, as shown in FIG. 2. The blank 47 defines a back member 7, the back member 7 being divided into a plurality of support sections 8, and the blank 47 defines a plurality of seat members 9, each attached to at least one support section 8. The seat members 9 are parallel and closely adjacent such that the only separation between the seat members 9 within the blank 47 is created by the act of cutting the blank 47. The seat members 9 have first and second side edges 38 and adjacent side edges 38 are formed by the same cut. Preferably, each seat member 9 preferably has a lower edge 37, the first side edge 38 of each seat member 9 has a retention tab 43 adjacent the lower edge 37 of the seat member 9, and the second side edge 38 of each seat member 9 has a retention tab 43 adjacent the lower edge 37 of the seat member 9.

The preferred material for the connector 6 of the present invention is 14 gauge, Grade 33, G-90 galvanized steel. Although this is the preferred material, the connector 6 can be made from any other suitable material or materials, both metals and non-metals. For example, the connector 6 could be made from cast aluminum or molded plastic.

In the most preferred embodiment, the connector 6 has four supports section 8 and four seat members 9 and is 9 inches wide, when flat (as shown in FIG. 2), from the outer side edge 20 of the first attachment section 14 to the outer side edge 20 of the second attachment section 14. The connector 6, when flat (as shown in FIG. 2) is preferably 7 inches tall from the upper edges 15 of the support sections 8 to the lower edges 37 of seat members 9. The support sections 8 are 3.5 inches from each upper edge 15 to each lower edge 16. The seat members 9 are 3.5 inches from each upper edge 36 to each lower edge 37. Connectors 6 of the present invention with fewer than four seat members 9 would be narrower, but the same height. Connectors 6 of the present invention with more than four seat members 9 would be wider, but also the same height. Connectors 6 of the present invention with three seat members 9 and five seat members 9 are contemplated.

The preferred fasteners 45 for both the connection between the connector 6 and the supporting structural member 2 and between the connector 6 and the supported structural members 4 are Simpson Strong-Tie SDS-series self-drilling 3-inch long, ¼-inch diameter, screws 4 (Model No. SDS25300).

The bearing strength of the connector 6 partially depends on the shear strength of the fastener 45 that joins the seat members 9 to the supported structural members 4.

Preferably, the supporting structural member 2 is a two-ply nominal 2×4 bottom chord girder.

The anticipated loads are 3000 pounds at 115 percent of required load duration for Douglas Fir and Southern Pine, and 2500 pounds at 115 percent of required load duration for Spruce Pine-Fir and Hemlock Fir. Duration of load is the total cumulative length of time that the full design load is applied. Wood is able to resist higher stresses when loads are applied for a short time duration.

In the preferred embodiments each seat member 9 carries a single supported structural member 4, but the connector 6 of the present invention can be made with one or more seat members 9 that carry multiple supported structural members 4. Likewise, in the preferred embodiments, each support section 8 is attached to a single seat member 9, but the connector 6 of the present invention can be made with support sections 8 that are attached to multiple seat members 9 or support sections 8 that do not have attached seat members 9. Also, although in the preferred embodiments each seat member 9 carries a single supported structural member 4, one or more seat members 9 can be left unoccupied by a supported structural member 4.

I claim:

1. A structural building connection (1) comprising:

a. a supporting structural member (2) having an attachment face (3);

b. a plurality of supported structural members (4) each having an attachment end (5), said plurality of supported structural members (4) being connected to said supporting structural member (2) at a plurality of angles to said supporting structural member (2) by;

c. a connector (6), comprising:

i. a back member (7), said back member (7) being divided into a plurality of adjacent support sections (8), each support section (8) being a generally planar member, with said support sections (8) being joined together at angular junctions (22); and ii. a plurality of substantially planar seat members (9), each of said seat members (9) having an upper edge (36), a lower edge (37), a first side edge (38) and a second side edge (38), said seat members (9) being separated from each other, each seat member (9) being attached to only one support section (8) at a single, substantially linear angular juncture (10) at said upper edge (36) of said seat member (3) with said remaining lower and first and second side edges (38) and (38) of said seat member (9) being separated from any other portion of said back member (7); wherein:

d. said back member (7) is fastened to said attachment face (3) of said supporting structural member (4); and e. at least one supported structural member (4) is supported by at least one of said seat members (9) adjacent said attachment end (5) of said supported structural member (4).

2. The structural building connection (1) of claim 1, wherein:

a. said connector (1) has a plurality of seat support embossments (11), each of said support embossments (11) passing through at least one of said angular junctures (10) from a support section (8) to a seat member (9) and reinforcing said angular juncture (10) between said support section (8) and said seat member (9).

3. The structural building connection (1) of claim 2, wherein:

a. said seat support embossments (11) are obround, each having a pair of substantially parallel sides (34) and a pair of rounded ends (35) that connect each pair of substantially parallel sides (34).

4. The structural building connection (1) of claim 2, wherein:

a. said seat support embossments (11) are substantially as wide as said seat members (9).

5. The structural building connection (1) of claim 2, wherein:

a. said back member (7) has a first attachment section (14) and a second attachment section (15);

b. said first attachment section (14) is angularly joined to a first support section (12);

c. said second attachment section (14) is angularly joined to a last support section (13);

d. said first attachment section (14) is fastened to said attachment face (3) of said supporting structural member (2); and e. said second attachment section (14) is fastened to said attachment face (3) of said supporting structural member (2).

6. The structural building connection (1) of claim 5, wherein:

a. each of said support sections (8) has an upper edge (15), a lower edge (16), a first side edge (17) and a second side edge (17).

7. The structural building connection (1) of claim 6, wherein:

a. each of said support sections (8) is generally rectangular, wherein:

i at least a portion of said upper edge (15) is straight and parallel to a straight portion of said lower edge (16);

ii. at least a portion of said first side edge (17) is straight and parallel to a straight portion of said second side edge (17).

8. The structural building connection (1) of claim 5, wherein:

a. said angular juncture (22) where said support sections (8) meet each other is reinforced by a substantially rigid embossment (23).

9. The structural building connection (1) of claim 8, wherein:

a. said first attachment section (14) and said first support section (8) meet at an angular juncture (24) that is reinforced by a substantially rigid embossment (25); and b. said second attachment section (14) and said last support section (8) meet at an angular juncture (24) that is reinforced by a substantially rigid embossment (25).

10. The structural building connection of claim 9, wherein:

a. said substantially rigid embossments (25) are gussets (25).

11. The structural building connection (1) of claim 5, wherein:

a. three separate fasteners (45) pass through each of said attachment sections (14) of said connector (6) into the attachment face (3) of said supporting structural member (2).

12. The structural building connection (1) of claim 1, wherein:

a. the first side edge (38) of each seat member (9) has a first retention tab (43) adjacent said lower edge (37) of said seat member (9); and b. the second side edge (38) of each seat member (9) has a second retention tab (43) adjacent said lower edge (37) of said seat member (9).

13. The structural building connection (1) of claim 1, wherein:

a. each of said seat members (9) has an upper face (39) and an lower face (40), said upper face (39) facing toward one of said supported structural members (4), and said lower face (40) facing away from one of said supported structural members (4); and b. each supported structural member (4) is supported only by the upper face (39) of one of said seat members (9).

14. The structural building connection (1) of claim 1, wherein:

a. each of said supported structural members (4) has a bottom face (46);

b. at least one separate fastener (45) passes through each of said seat members (9) of said connector (6) into the bottom face (46) of one of said supported structural members (4), and only said bottom faces (46) of said supported structural members (4) receive any fasteners (45) that pass through said connector (1).

15. The structural building connection (1) of claim 14, wherein:

a. only one separate fastener (45) passes through each of said seat members (9) into the bottom face (46) of one of said supported structural members (4).

16. The structural building connection (1) of claim 15, wherein:

a. said fasteners (45) are screws.

17. The structural building connection (1) of claim 1, wherein:

a. each supported structural member (4) has a relatively planar end face (48) and first and second relatively planar, elongated sides 44 that are generally disposed orthogonally to said end face 48 and parallel to each other, said end face (48) being disposed closely adjacent, and parallel to, one of said support sections (8) of said back member (7) of said connector (6) and being substantially as wide as the support section (8) to which it is closely adjacent.

18. The structural building connection (1) of claim 17, wherein:

a. each end face (48) of each supported structural member (4) abuts one of said support sections (8) of said back member (7) of said connector (6).

19. The structural building connection (1) of claim 18, wherein:

a. each supported structural member has a bottom face (46); and b. only one separate fastener (45) passes through each of said seat members (9) into the bottom face (46) of one of said supported structural members (4).

20. The structural building connection (1) of claim 17, wherein:

a. said connector (1) has a plurality of seat support embossments (11), each of said support embossments (11) passing through at least one of said angular junctures (10) from a support section (8) to a seat member (9) and reinforcing said angular juncture (10) between said support section (8) and said seat member (9).

21. The structural building connection of claim 20, wherein:

a. said support sections (8) and said seat members (9) are substantially rectangular.

22. The structural building connection (1) of claim 21, wherein:

a. said angular juncture (22) where said support sections (8) meet each other is reinforced by a substantially rigid embossment (23).

23. The structural building connection (1) of claim 21, wherein:

a. the first side edge (38) of each seat member (9) has a first retention tab (43) adjacent said lower edge (37) of said seat member (9); and b. the second side edge (38) of each seat member (9) has a second retention tab (43) adjacent said lower edge (37) of said seat member (9).

24. The structural building connection (1) of claim 20, wherein:

a. said seat support embossments (11) are substantially as wide as said seat members (9).

25. The structural building connection (1) of claim 17, wherein:

a. each of said support sections (8) has an outer face (26) and an inner face (27), said outer face (26) facing out and away from said supporting structural member (2), and said inner face (27) facing in and toward said supporting structural member (2), wherein:

i. said inner faces (27) of said support sections (8) do not interface with said supporting structural member (2).

26. The structural building connection (1) of claim 25, wherein:

a. each of said support sections (8) of said back member (7) is angularly joined to another of said support sections (8);

b. said support sections (8) are joined in series from a first support section (12) to a last support section (13).

27. The structural building connection (1) of claim 1, wherein:

a. each of said support sections (8) has an outer face (26) and an inner face (27), said outer face (26) facing out and away from said supporting structural member (2), and said inner face (27) facing in and toward said supporting structural member (2), wherein:

i. said inner faces (27) of said support sections (8) do not interface with said supporting structural member (2).

28. The structural building connection (1) of claim 27, wherein:

a. each of said support sections (8) of said back member (7) is angularly joined to another of said support sections (8);

b. said support sections (8) are joined in series from a first support section (12) to a last support section (13).

29. A method of forming a structural building connector (6) adapted for connecting a plurality of elongated supported structural members (4) at a plurality of angles to a supporting structural member (2) having a substantially planar attachment face (3), comprising:

a. cutting a generally rectangular blank (47) from sheet metal, wherein:

i. said blank (47) defines a back member (7), said back member (7) being divided into a plurality of rectangular support sections (8), each of said support sections (8) having an upper edge (15), a lower edge (16), a first side edge (17) and a second side edge (17), and said blank (47) defines a plurality of generally rectangular seat members (9), each of said seat members (9) having an upper edge (36), a lower edge (37), a first side edge (38) and a second side edge (38), each said seat member being attached to only one support section (8) at a single, substantially linear juncture (10) at said upper edge (36) of said seat member (3); wherein:

1. said seat members (9) are parallel and closely adjacent such that the only separation between said seat members (9) within the blank (47) is created by the act of cutting the blank (47); and 2. adjacent side edges (38) of said seat members (9) are formed by the same cut;

b. bending said blank (47) at said first and second side edges (17) of said support sections (8) such that each of said support sections (8) of said back member (7) is angularly joined to another of said support sections (8), and said support sections (8) are joined in series from a first support section (12) to a last support section (13), and said seat members (9) are separated from each other, with said remaining lower and first and second side edges (38) and (38) of said seat member (9) being separated from any other portion of said back member (7); and c. bending said blank (47) at said substantially linear juncture (10) at said upper edge (36) of each of said seat members (3) such that each said seat member (3) is angularly disposed to said support section (8) to which it is attached.

30. The structural building connection (1) of claim 29, wherein:

a. the first side edge (38) of each seat member (9) has a first retention tab (43) adjacent said lower edge (37) of said seat member (9);

b. the second side edge (38) of each seat member (9) has a second retention tab (43) adjacent said lower edge (37) of said seat member (9).

* * * * *